US010845763B2

(12) United States Patent
Cusin et al.

(10) Patent No.: US 10,845,763 B2
(45) Date of Patent: Nov. 24, 2020

(54) SHOCK ABSORBER BEARING FOR AN ARBOR OF A TIMEPIECE WHEEL SET

(71) Applicant: Nivarox-FAR S.A., Le Locle (CH)

(72) Inventors: Pierre Cusin, Villars-Burquin (CH); Ivan Hernandez, Cressier (CH)

(73) Assignee: Nivarox-FAR S.A., Le Locle (CH)

( * ) Notice: Subject to any disclaimer, the term of this patent is extended or adjusted under 35 U.S.C. 154(b) by 248 days.

(21) Appl. No.: 15/997,767

(22) Filed: Jun. 5, 2018

(65) Prior Publication Data

US 2019/0004480 A1 Jan. 3, 2019

(30) Foreign Application Priority Data

Jun. 29, 2017 (EP) ..... 17178829

(51) Int. Cl.
*G04B 31/02* (2006.01)
*G04B 31/04* (2006.01)
*G04B 31/008* (2006.01)

(52) U.S. Cl.
CPC ..... *G04B 31/02* (2013.01); *G04B 31/0087* (2013.01); *G04B 31/04* (2013.01)

(58) Field of Classification Search
CPC .... G04B 31/02; G04B 31/0087; G04B 31/04; G04B 37/052; G04B 37/055; G04B 43/002; G04B 37/0418
USPC ..... 368/326
See application file for complete search history.

(56) References Cited

U.S. PATENT DOCUMENTS 10,114,339 B2 * 10/2018 Merino ..... G04B 37/052
10,452,027 B2 * 10/2019 Droz ..... G04B 37/055

FOREIGN PATENT DOCUMENTS

CH 705 075 A2 12/2012
EP 3 070 544 A1 9/2016

OTHER PUBLICATIONS

European Search Report dated Dec. 8, 2017, issued in European Application EP 17178829.2, filed Jun. 29, 2017 (with English Translation of Categories of Cited Documents).

* cited by examiner

*Primary Examiner* — Edwin A. Leon
(74) *Attorney, Agent, or Firm* — Oblon, McClelland, Maier & Neustadt, L.L.P.

(57) ABSTRACT

A shock absorber bearing for an arbor of a timepiece wheel set, particularly for a balance staff. The bearing includes a bearing assembly including a housing, a bearing support arranged inside the housing and including an external centring wall, a pivot bearing mounted on the bearing support for receiving a pivot of a wheel set arbor and an elastic support arrangement for the wheel set arbor pivot. The shock absorber bearing further includes a device for recentring play. This device for recentring play includes, on the one hand, a first part including a centring element having an internal centring wall in which is arranged the external centring wall of the bearing support, and on the other hand, a second part resting on the bearing assembly and arranged to have a return effect on the first part.

15 Claims, 2 Drawing Sheets

Fig.1a - Prior Art
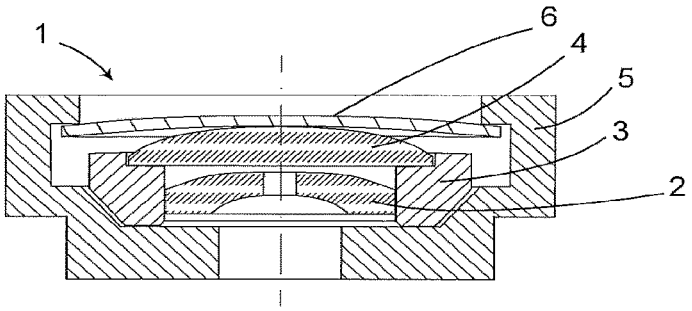
Fig.1b - Prior Art
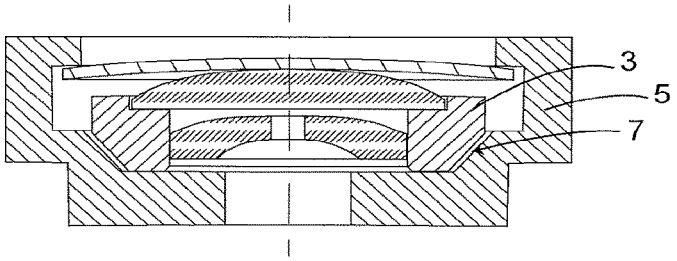
Fig.1c - Prior Art
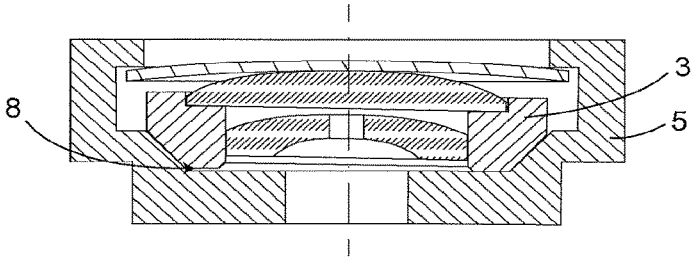
Fig.2
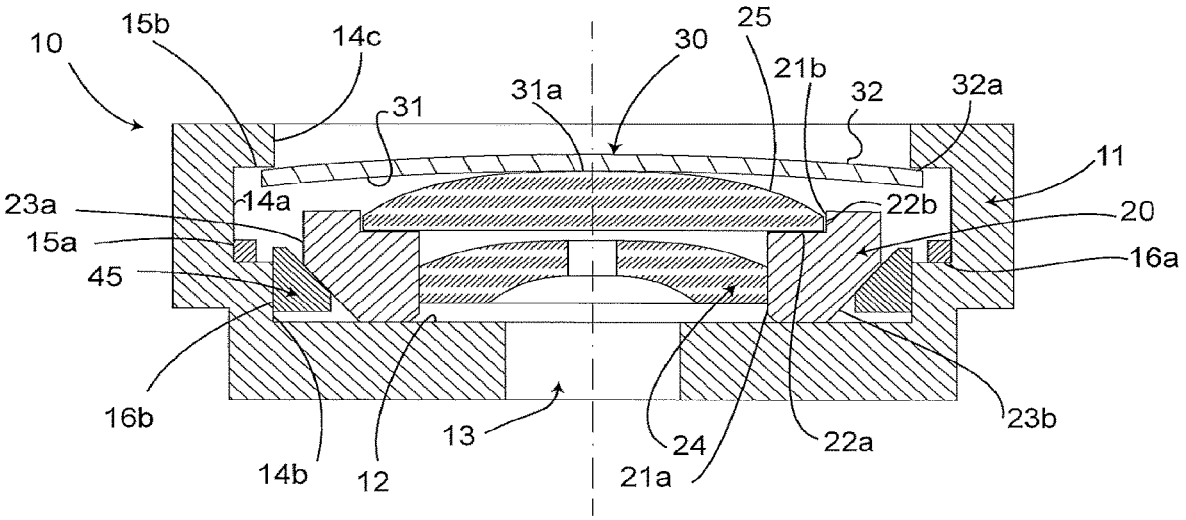

SHOCK ABSORBER BEARING FOR AN ARBOR OF A TIMEPIECE WHEEL SET

This application claims priority from European Patent Application No. 17178829.2 filed on Jun. 29, 2017, the entire disclosure of which is hereby incorporated herein by reference.

FIELD OF THE INVENTION

The present invention concerns a shock absorber bearing for an arbor of a timepiece wheel set, particularly for a balance staff, and comprising a device for recentring play.

BACKGROUND OF THE INVENTION

In horology, the pivots of the wheel set arbors rotate in bearings mounted in the plate or in bridges. For some wheels and pinions, in particular the balance, it is customary to equip the bearings with a shock absorber mechanism. Indeed, as the balance staff pivots are generally thin, and the mass of the balance is relatively high, the pivots can break under impact in the absence of a shock absorber mechanism.

The configuration of a conventional shock absorber bearing 1 is represented in FIG. 1*a*. A domed olive hole jewel 2 is driven into a bearing support 3, commonly called a 'setting', on which is mounted an endstone 4. Setting 3 is held resting against the bottom of a bearing assembly 5 by a shock absorber spring 6, arranged to exert an axial force on the upper part of endstone 4. Setting 3 further comprises a conical external wall arranged to correspond with an inner conical wall disposed at the periphery of the bottom of bearing assembly 5. Variants also exist wherein the setting has an external wall having a surface of convex, i.e. domed, shape.

For satisfactory operation, setting 3 must be properly centred on the arbor of the shock absorber bearing and flat, which is not easy to guarantee due to the tolerance range of the components.

In the first configuration, as illustrated in FIG. 1*b*, the centring position of setting 3 on the axis of rotation of the bearing has the drawback of being undefined, whereas in the second configuration, as illustrated in FIG. 1*c*, setting 3 can pivot about an axis perpendicular to the axis of the shock absorber bearing, which has the unfortunate consequence of positioning setting 3, and the pivot and endstone mounted thereon, at an angle.

SUMMARY OF THE INVENTION

It is therefore an object of the invention to propose a shock absorber bearing for an arbor of a timepiece wheel set, particularly for a balance staff, wherein the tolerance ranges of the components of the shock absorber bearing do not lead to the two aforementioned undesirable situations.

To this end, the invention concerns a shock absorber bearing for an arbor of a timepiece wheel set, particularly for a balance staff. The bearing comprises a bearing assembly comprising a housing, a bearing support arranged inside the housing and comprising an external centring wall, a pivot bearing mounted on the bearing support for receiving a pivot of the wheel set arbor and an elastic support arrangement for the pivot of the wheel set arbor. The shock absorber bearing further comprises a device for recentring play. This device for recentring play comprises, on the one hand, a first part comprising a centring element having an internal centring wall in which is arranged the external centring wall of the bearing support, and on the other hand, a second part resting on the bearing assembly and arranged to have a return effect on the first part.

This return effect allows the centring element of the play recentring device to fit against the bearing support regardless of any manufacturing variations and ensures that the bearing support is centred and rests flat against the bottom of the bearing assembly.

According to an advantageous embodiment, the external centring wall of the bearing support and the internal centring wall of the centring element are both walls of conical shape. The taper of the internal centring wall of the centring element matches the taper of the external centring wall of the bearing support.

According to another embodiment, the external centring wall of the bearing support is convex, and the internal centring wall of the centring element is conical.

According to another embodiment, the external centring wall of the bearing support is conical, and the internal centring wall of the centring element is convex.

According to an advantageous embodiment, the bearing assembly comprises an internal wall comprising a cylindrical shoulder having a radial bearing surface and an axial bearing surface. The second portion of the play recentring device comprises an annular portion arranged on the radial bearing surface of the shoulder and an elastic portion extending beyond the radial bearing surface towards the axis of the bearing.

According to an advantageous embodiment, the elastic portion comprises several flexible strips arranged along a circular trajectory for example. The flexible strips are configured to bend essentially axially under impact and to offset any end-play and ensure that the bearing support is centred.

According to an advantageous embodiment, the centring element comprises an external wall having several reinforcement and centring assemblies, said assemblies limiting the radial movement of the bearing support and, with the rest of the centring element, allowing any end-play to be offset and ensuring that the bearing support is centred. Both ends of each flexible strip are respectively connected to a corresponding assembly and to the annular portion of the second part of the play recentring device.

According to an advantageous embodiment, each reinforcement assembly comprises a bearing surface arranged against the axial bearing surface of the shoulder for centring the bearing support. Each flexible strip has an external lateral wall set back from the bearing surface of each assembly.

According to an advantageous embodiment, the axis of curvature of the flexible strips of the elastic portion corresponds to the bearing axis.

According to an advantageous embodiment, the annular portion of the second part of the play recentring device has a square or rectangular cross-section. The annular portion is prestressed (driven in, for example) to exert a force against a corner formed by the radial bearing surface of the shoulder and an axial bearing surface of the internal bearing assembly wall.

According to an advantageous embodiment, the bearing assembly comprises a base having an opening for passage of the wheel set arbor pivot. The bearing support rests against the base of the bearing assembly. The centring element of the first part of the play recentring device is remote from the base when the shock absorber bearing is in a rest configuration, i.e. when the bearing is not subjected to any external force.

According to an advantageous embodiment, the play recentring device is in a monolithic form.

BRIEF DESCRIPTION OF THE DRAWINGS

Other features and advantages of the present invention will appear upon reading the description of several embodiments given purely by way of non-limiting example, with reference to the annexed drawings, in which:

FIG. 1*a* shows an axial cross-section of a shock absorber bearing according to the state of the art.

FIGS. 1*b* and 1*c* represent a similar view to FIG. 1*a*, wherein the setting is respectively in a first and a second position.

FIG. 2 shows an axial cross-section of a shock absorber bearing according to one embodiment of the invention.

DETAILED DESCRIPTION OF PREFERRED EMBODIMENTS

A shock absorber bearing for a wheel set arbor, in particular for a balance staff, of a timepiece will now be described according to one embodiment, with reference to FIGS. 2 to 5.

Figure 3:
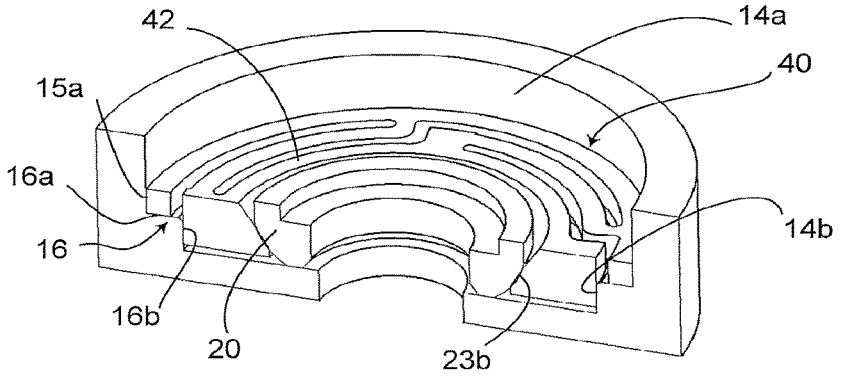
FIG. 3 represents a partial truncated view of a cross-section of the shock absorber bearing of FIG. 2.

Referring in particular to FIGS. 2 and 3, the shock absorber bearing 10 comprises a bearing assembly 11 (hereinafter the "bearing assembly"), a bearing support 20, an elastic member 30 and a play recentring device 40. The external cover of bearing assembly 11 is shaped to be inserted into one or more orifices present in the plate or in one or more bridges of a timepiece movement (not illustrated). When shock absorber bearing 10 is used, for example for a balance, the index assembly and balance spring stud-holder are disposed around bearing assembly 11. This bearing assembly 11 comprises a base 12 having a preferably cylindrical opening 13, for passage of a pivot of the balance staff.

Bearing assembly 11 further comprises an internal lateral wall defining a housing for receiving the bearing support 20, more commonly known as a 'setting'. The internal lateral wall comprises a main cylindrical wall 14*a* and first and second complementary cylindrical walls 14*b*, 14*c*, arranged on either side of main cylindrical wall 14*a*, and referred to as lower cylindrical wall 14*b* and upper cylindrical wall 14*c*.

The diameter of each of lower and upper walls 14*b*, 14*c* is smaller than the diameter of main wall 14*a* of the internal lateral wall of bearing assembly 11. Lower wall 14*b* thus forms, with main wall 14*a*, a cylindrical shoulder 16. Shoulder 16 forms, with main wall 14*a*, a corner having an axial bearing surface 15*a* and a radial bearing surface 16*a* extending over 360° and centred on the axis of shock absorber bearing 10. Upper cylindrical wall 14*c* forms, with main wall 14*a*, a radial bearing surface 15*b* arranged substantially facing radial bearing surface 16*a* of shoulder 16. In the variant shown, upper wall 14*c* forms a rim allowing to attach elastic member 30. It is evident that other means can be implemented for attaching elastic member 30 such that the rim formed by upper wall 14*c* can be omitted, with the upper part of main wall 14*a* then being straight.

Setting 20 comprises an internal lateral wall comprising a main cylindrical wall 21*a* and a complementary cylindrical wall 21*b*. A pivot bearing 24, in the form of a domed olive hole jewel, is mounted inside the main cylindrical wall to hold the balance staff in axial alignment. Jewel hole 24 is preferably driven in but may also be adhesive bonded or attached in any other manner to the main cylindrical wall of the internal wall of the setting.

The diameter of main cylindrical wall 21*a* of setting 20 is smaller than the diameter of complementary cylindrical wall 21*b* so as to form a corner extending over 360°.

The elastic support arrangement comprises an endstone 25 mounted on bearing support 20 and an elastic member 30 arranged to exert an axial force on bearing support 20. Endstone 25 is of cylindrical shape and is mounted above jewel hole 24. More particularly, the peripheral part of endstone 25 is held against a radial 22*a* and axial 22*b* bearing surface of the corner of setting 20 by means of elastic member 30, which is mounted inside the housing of bearing assembly 11. Elastic member 30 may have the known lyre shape and it comprises a lower side 31, whose central part 31*a* rests against the upper part of endstone 25, and an upper side 32, whose peripheral part 32*a* rests against radial bearing surface 15*b* of bearing assembly 11. Elastic member 30 is in a prestressed configuration so as to exert optimum axial force against endstone 25 when shock absorber bearing 10 is in a rest configuration in which it is not subjected to any external force. It will be noted that this elastic member can take various forms and may be coupled to bearing assembly 11 by other means. For example, the elastic member can have a shape that partially covers endstone 25.

Referring to FIGS. 2 to 5, play recentring device 40 comprises a first part comprising a centring element 42 resting against setting 20 and a second part comprising a peripheral area resting on bearing assembly 11, as will be described below, so that the second part has a return effect with regard to the first part. More particularly, centring element 42 comprises an internal wall comprising a conical wall 43*a* and a complementary cylindrical wall 43*b* and an external wall 44 of cylindrical shape.

Figure 5:
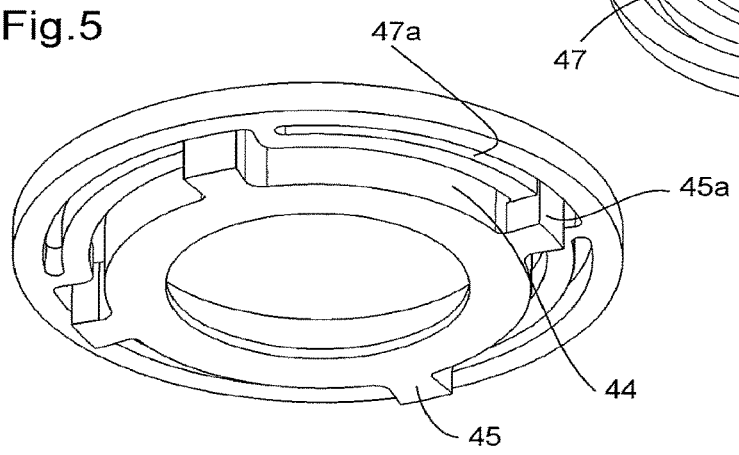
FIG. 5 shows a perspective bottom view of FIG. 4.

In FIG. 5, several reinforcement assemblies 45 are arranged on external wall 44. In this embodiment, four assemblies 45 are arranged, preferably at 90° with respect to each other. It will be noted, however, that an embodiment with a different number of assemblies can be envisaged, for example three assemblies preferably arranged at 120° to each other. Each assembly 45 comprises a bearing surface 45*a* arranged to be resting against axial bearing surface 16*b* of shoulder 16 of bearing assembly 11.

The second part of play recentring device 40 comprises an annular portion 46 resting entirely on radial bearing surface 16*a* of shoulder 16 of bearing assembly 11 and a second elastic portion extending beyond radial bearing surface 16*a* towards the axis of bearing 10 and connected to centring element 42. Annular portion 46 is of essentially constant cross-section and, for example, square in shape (FIG. 2). Annular portion 46 is prestressed to exert a force against the corner formed by radial bearing surface 16*a* of shoulder 16 and axial bearing surface 15*a* of main cylindrical wall 14*a* of bearing assembly 11 so as to couple recentring element 42 to bearing assembly 11. Of course, other forms of coupling can be implemented.

The elastic portion of the second part comprises several flexible strips 47 arranged along a, for example, circular trajectory, concentric to centring element 42. These strips 47 are connected to reinforcement assemblies 45 and are configured to bend essentially axially under impact, and to offset any end-play linked, in particular, to manufacturing variations and to ensure that setting 20 is centred and resting flat at the bottom of bearing assembly 11.

Figure 4:
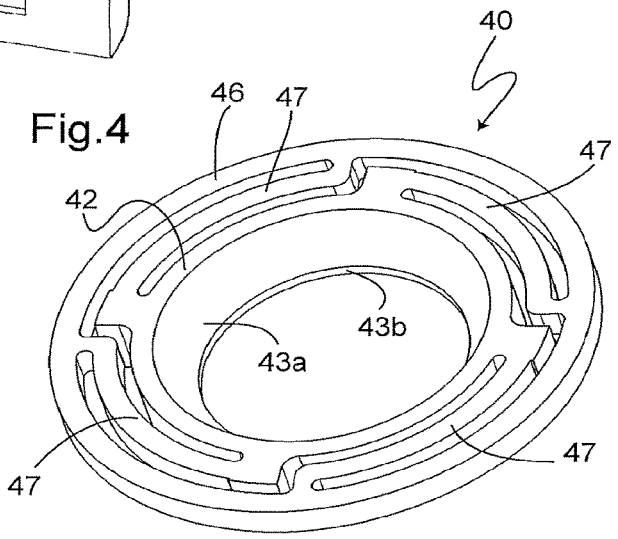
FIG. 4 shows a perspective top view of the play recentring device of FIG. 2.

In FIG. 4, the elastic portion preferably comprises four flexible strips 47 which each extend along the arc of a circle comprised between 60° and 85°, but a different number of strips can be envisaged, for example three strips each extending along an arc of a circle comprised between 90° and 115°.

As can be seen in FIG. 5, external lateral wall 47*a* of each strip 47 is slightly set back from bearing surface 45*a* of each assembly 45. This prevents flexible strips 47 "rubbing" against axial surface 16*b* of shoulder 16 of bearing assembly 11 when the strips bend axially to absorb stresses caused by an essentially axial shock thereby avoiding premature wear of the strips.

Figure 6:
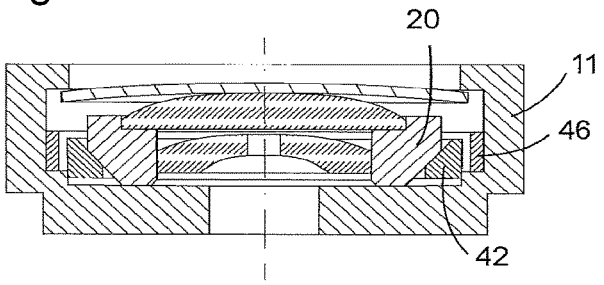
FIG. 6 represents an axial cross-section of the shock absorber bearing according to another embodiment.

The ratio between the axial height of centring element 42 and the axial height of annular portion 46 is greater than two in the embodiment illustrated in FIG. 2, whereas this ratio can be approximately equal to one according to an embodiment illustrated in FIG. 6. It will be noted that according to this latter embodiment, external lateral wall 47*a* of each strip 47 does not need to be set back from bearing surface 45*a* of each assembly 45. Indeed, only the lower part of bearing surface 45*a* of each assembly 45 is arranged against axial bearing surface 16*b* of shoulder 16, so that the strips can bend radially above radial bearing surface 16*a* of shoulder 16 owing to a clearance between the internal lateral wall of annular portion 46 and external lateral wall 47*a* of flexible strips 47.

It is to be noted that the dimensions of flexible strips 47 and the material of play recentring device 40 must be carefully selected and take account of several factors. For example, the strips must be able to bend sufficiently axially for insertion of elastic member 30 and to not result in oversizing of the elastic member. Conversely, strips 47 must not be too flexible either, so as to ensure proper (re)centring of the setting.

The play recentring device is preferably in the form of a monolithic component. This component can be made either of metal or alloy, or silicon, or a plastic elastomer material. When the spring is made of metal, alloy or silicon, its contour can be created for example by etching, or by photolithography and galvanic growth. In the case of a plastic material, an injection moulding technique will be used, for example.

The shock absorber bearing and its play recentring device according to the present invention eliminate any uncertainty in the centring or support of the setting, linked to dimensional tolerances of the components, by means of the active self-centring and end-play correction effect of the play recentring device. Indeed, because of the return effect of the second part of the play recentring device, centring element 42 of the play recentring device according to the invention is returned upwards. The position of the internal centring wall of the centring element will be adjusted against the external conical centring wall of the bearing support at a height that depends on the set of tolerances: if there is not much play, the position is low, and if there is a lot of play, the position is high. This eliminates uncertainty in the centring or support of the bearing support, linked to the dimensional tolerances of the components. Further, the bearing support can be both centred and pressed flat, which is indispensable for this balance guiding component.

Naturally, the invention is not limited to the embodiments described with reference to the Figures and variants could be envisaged without departing from the scope of the invention. For example, the endstone and the elastic member could be made in one piece. Further, although the centring walls of the bearing support and of the centring element of the play recentring device are conical in shape, with the taper of internal centring wall 43*a* of centring element 32 preferably corresponding to the taper of external centring wall 23*b* of bearing support 20, other centring wall profiles could be adapted to perform the centring function. In particular, external centring wall 23*b* of bearing support 20 may be convex and internal centring wall 43*a* of centring element 42 conical, or external centring wall of the bearing support may be conical and internal centring wall 43*a* of centring element 42 convex.

What is claimed is:

1. A shock absorber bearing for an arbor of a timepiece wheel set, comprising:

a bearing assembly comprising a housing, a bearing support arranged inside the housing and comprising an external centering wall, a pivot bearing mounted on the bearing support for receiving a pivot of the wheel set arbor and an elastic support arrangement for the wheel set arbor pivot, the shock absorber bearing further comprising a play recentering device, wherein the play recentering device comprises a first part comprising a centering element having an internal centering wall inside which is arranged the external centering wall of the bearing support, wherein the play recentering device further comprises a second part resting on the bearing assembly and arranged to have a return effect on the first part, and wherein the bearing assembly comprises an internal wall comprising a cylindrical shoulder having a radial bearing surface and an axial bearing surface and wherein said second part of the play recentering device comprises an annular portion arranged on the radial bearing surface of the shoulder and an elastic portion extending beyond said radial bearing surface towards the axis of the bearing.

2. The bearing according to claim 1, wherein the external centering wall of the bearing support and the internal centering wall of the centering element are both conical walls, the taper of the internal centering wall of the centering element matching the taper of the external centering wall of the bearing support.

3. The bearing according to claim 1, wherein the external centering wall of the bearing support is convex and the internal centering wall of the centering element is conical.

4. The bearing according to claim 1, wherein the external centering wall of the bearing support is conical and the internal centering wall of the centering element is convex.

5. The bearing according to claim 1, wherein the elastic portion comprises several flexible strips being configured to bend essentially axially under impact and to offset any end-play and ensure that the bearing support is centered.

6. The bearing according to claim 5, wherein the flexible strips are arranged along a circular trajectory.

7. The bearing according to claim 5, wherein the centering element comprises an external wall having several reinforcement and centering assemblies, both ends of each flexible strip being respectively connected to a corresponding assembly and to the annular portion of the second part of the second part of the play recentering, device.

8. The bearing according to claim 6, wherein the centering element comprises an external wall having several reinforcement and centering assemblies, both ends of each flexible strip being respectively connected to a corresponding assembly and to the annular portion of the second part of the second part of the play recentering device.

9. The bearing according to claim 7, wherein each reinforcement assembly comprises a bearing surface arranged against the axial bearing surface of the shoulder, each flexible strip comprising an external lateral wall set back from the bearing surface of each assembly.

10. The bearing according to claim 5, wherein the axis of curvature of the flexible strips of the elastic portion corresponds to the bearing axis.

11. The bearing according to claim 5, wherein the annular portion of the second pan of the play recentering device has a square or rectangular cross-section, the annular portion being prestressed to exert a force against a corner formed by the radial bearing surface of the shoulder and an axial bearing surface of the internal wall of the bearing assembly.

12. The bearing according to claim 1, wherein the bearing assembly comprises a base having an opening for passage of the pivot of the wheel set arbor, the bearing support resting on the base, the centering element of said first part being spaced apart from the base when the bearing is in a rest configuration.

13. A timepiece movement comprising:

a plate and at least one bridge, said plate and/or bridge comprising an orifice in which is inserted the bearing according to claim 1.

14. The bearing according to claim 1, wherein the cylindrical shoulder is centered on an axis of the shock absorber bearing.

15. The bearing according to claim 12, wherein the opening of the bearing assembly is cylindrical.

* * * * *